US008024864B2

(12) United States Patent
Mortensen

(10) Patent No.: US 8,024,864 B2
(45) Date of Patent: Sep. 27, 2011

(54) RATCHETING CUTTING TOOL FOR PLASTIC PIPES

(75) Inventor: Mark A. Mortensen, Wheat Ridge, CO (US)

(73) Assignee: Duane D. Robertson, Golden, CO (US)

( * ) Notice: Subject to any disclaimer, the term of this patent is extended or adjusted under 35 U.S.C. 154(b) by 355 days.

(21) Appl. No.: 12/329,290

(22) Filed: Dec. 5, 2008

(65) Prior Publication Data

US 2010/0139100 A1 Jun. 10, 2010

(51) Int. Cl.
*B26B 13/00* (2006.01)
*B25B 7/12* (2006.01)
*B25B 7/00* (2006.01)

(52) U.S. Cl. ..... 30/250; 30/92; 30/188; 30/192

(58) Field of Classification Search ..... 30/92, 98, 30/99, 100, 101, 250, 251, 254, 188, 190, 30/191, 192, 193; D8/5, 60
See application file for complete search history.

(56) References Cited

U.S. PATENT DOCUMENTS 3,210,844 A * 10/1965 Tontscheff ..... 30/250
4,084,317 A * 4/1978 Nakamura et al. ..... 30/94
4,178,682 A * 12/1979 Sadauskas ..... 30/250
4,378,636 A 4/1983 Wick
4,599,795 A * 7/1986 Yokoyama ..... 30/188
4,779,342 A * 10/1988 Kobayashi et al. ..... 30/250
5,129,158 A 7/1992 Campagna
5,218,768 A 6/1993 Putsch et al.
5,526,570 A * 6/1996 Beetz et al. ..... 30/250
5,718,051 A 2/1998 Huang
5,862,593 A 1/1999 Huang
D423,895 S 5/2000 Azkona
6,098,291 A 8/2000 Wang
6,154,966 A 12/2000 Kobayashi
6,305,087 B1 10/2001 Huang
D453,287 S 2/2002 Picaza
6,766,581 B2 7/2004 Nordlin
D497,784 S 11/2004 Picaza
6,935,031 B1 8/2005 Huang
7,127,819 B1 10/2006 Huang
7,204,021 B2 4/2007 Houseman et al.
2002/0066188 A1 6/2002 Wu
2004/0045174 A1 3/2004 Nordlin
2005/0172499 A1 * 8/2005 Huang ..... 30/250
2007/0022610 A1 2/2007 Huang
2008/0307657 A1 * 12/2008 Macsay et al. ..... 30/250

* cited by examiner

*Primary Examiner* — Laura M. Lee
(74) *Attorney, Agent, or Firm* — W. Scott Carson

(57) ABSTRACT

A ratcheting cutting tool for plastic pipes having first and second, elongated rigid members pivotally mounted to each other. Each rigid member has a handle and the first rigid member additionally has an anvil at an end opposite from its handle. A spring-biased, knife blade member with a cutting edge and with a plurality of ratchet teeth is pivotally mounted to the first member. The tool further includes drive and catch pawls pivotally mounted to the respective rigid members. In operation, the handles of the rigid members can be repeatedly squeezed together to progressively move the cutting edge of the knife blade member in a step-by-step manner toward the anvil to cut through a plastic pipe positioned therebetween. A manually operated release mechanism is also disclosed wherein both the drive and catch pawls can be moved in one motion to release positions spaced from engagement with the ratchet teeth to permit the spring-biased knife blade member to be automatically returned to its open position after each cut.

17 Claims, 11 Drawing Sheets

RATCHETING CUTTING TOOL FOR PLASTIC PIPES

BACKGROUND OF THE INVENTION

1. Field of the Invention

This invention relates to the field of hand tools for cutting plastic pipes and more particularly to the field of such hand tools with ratcheting mechanisms to progressively advance the cutting blade in a step-by-step manner through the pipe.

2. Discussion of the Background

Ratcheting cutting tools are widely used to cut plastic pipes (e.g., polyethylene) and in particular, hard plastic pipes including those made of polyvinylchloride (PVC). In use, such hand tools must be fairly strong and preferably easy to operate. However, most commercially available tools often have a relatively large number of moving parts and are normally somewhat complicated not only to make but also to use.

In many ratcheting cutters, the cutting blade is spring biased toward its open position and the tool has a release mechanism to let the spring automatically move the blade to its open position. These cutters further complicate the design of the cutter but offer advantages in time and ease over ones that must be manually opened after each cut in particular, manually operated ones often cannot easily be opened with one hand and require the operator either to use both of his hands to do so or to grip one handle and catch the other handle on his leg or something else. In close quarters such as in a hole installing irrigation pipes, there often is not room enough to grip both handles or otherwise manually manipulate the handles to open the cutter. Regardless, having to open the handles of such tools after each cut of a multiple cut operation can understandably be very time consuming and certainly less desirable than tools with spring arrangements to automatically open the cutter after each use.

Cutters with such spring arrangements typically include a release mechanism as indicated above wherein the blade of the completely ratcheted closed cutter can be released to return under the force of the spring to its open position. The cutting blade in this regard may be in its ratcheted closed position because it is the first cut of the day and the cutter was stored with the blade closed for safety or the user has just finished a cut and the closed blade is ready to be opened for the next one. Known cutters with spring arrangements and release mechanisms can be fairly involved. In many cases, there is a two or more step procedure or movement of various parts to release the blade to return to its open position. These arrangements can be for the most part both expensive to make and fairly difficult to use.

With this and other problems in mind, the present invention was developed. In it, a ratcheting cutting tool is provided that has a release mechanism that with one motion will disengage both the drive and catch pawls of the ratcheting arrangement in an easy and simple manner to permit the spring-biased blade to be automatically returned to its open position after each cut.

SUMMARY OF THE INVENTION

This invention involves a ratcheting cutting tool for plastic pipes. The tool includes first and second, elongated rigid members pivotally mounted to each other. Each rigid member has a handle and the first rigid member additionally has an anvil at an end opposite from its handle. A knife blade member with a cutting edge and with a plurality of ratchet teeth is pivotally mounted to the first member. The tool further includes drive and catch pawls pivotally mounted to the respective rigid members. In operation, the handles of the rigid members can be repeatedly squeezed together to progressively move the cutting edge of the knife blade member in a step-by-step manner toward the anvil to cut through a plastic pipe positioned therebetween.

The knife blade member is spring biased toward an open position away from the anvil and the cutting tool includes a manual release mechanism. The release mechanism is a single, one-piece lever member that with one motion will disengage both the drive and catch pawls from the ratchet teeth to permit the spring-biased blade to be automatically returned to its open position after each cut. Additionally, the force (e.g., the user pressing his thumb against the lever member) to activate the release is applied to the lever member in a direction substantially in or immediately adjacent the central plane of the rigid members. The applied force and the movement of the lever member of the release mechanism are then effectively in or along the central plane. Consequently, there is little or no torque or twisting force on the cutting tool in the user's hand.

DETAILED DESCRIPTION OF THE INVENTION

Figure 1:
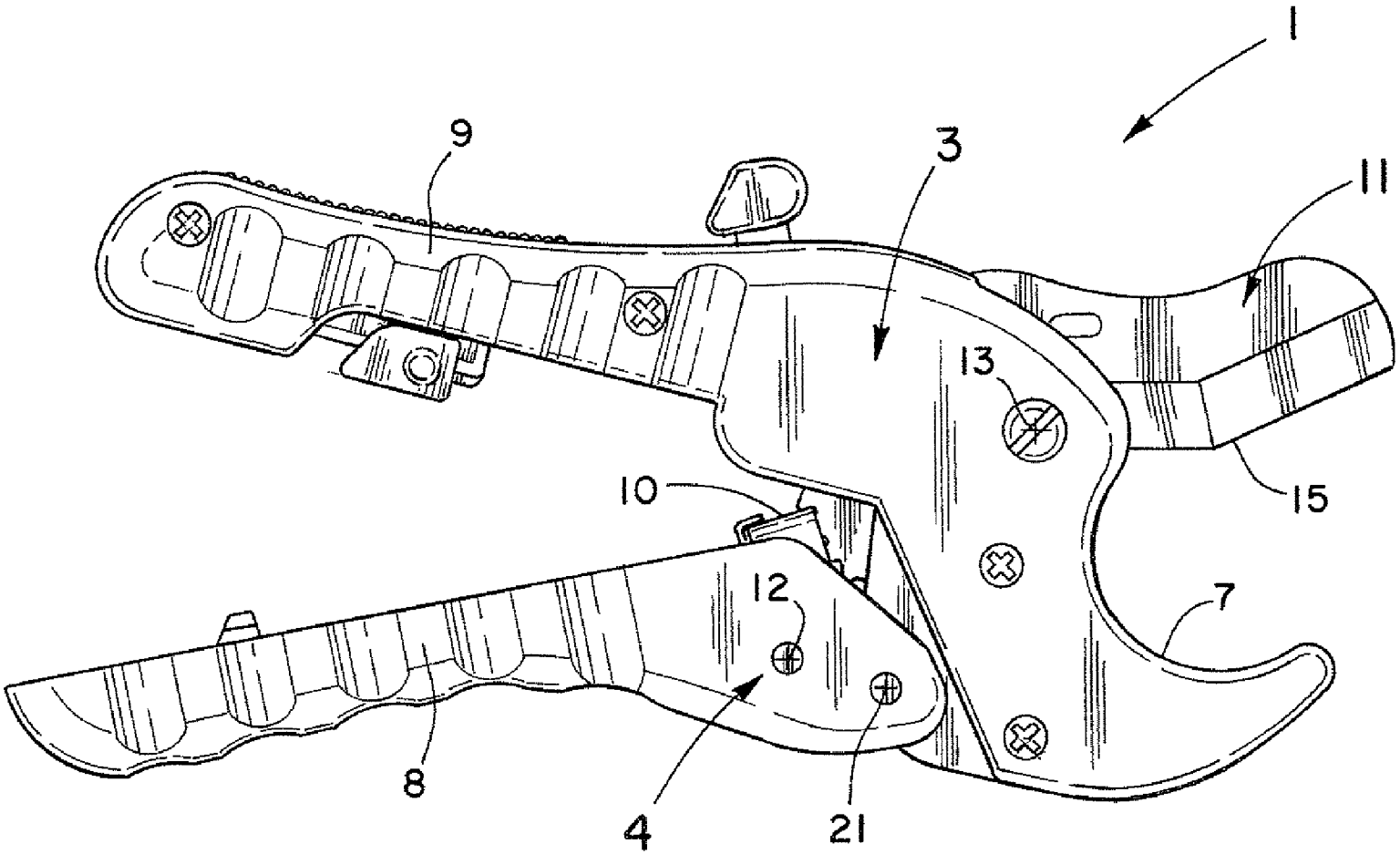
FIG. 1 is side view of the cutting tool of the present invention.
Figure 2:
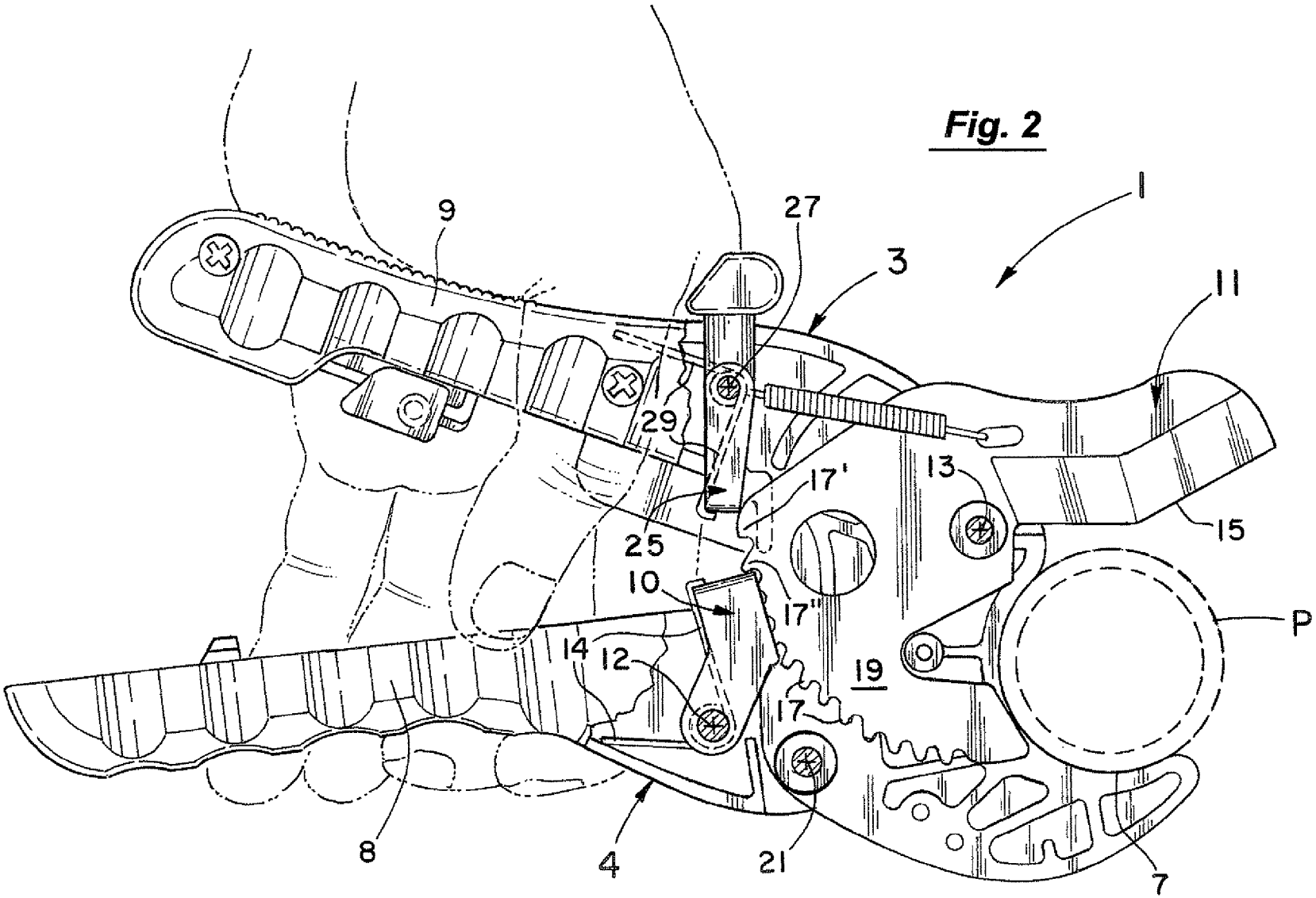
FIG. 2 is a partially cutaway view of the tool of FIG. 1 showing its operating parts.

The ratcheting cutting tool 1 of the present invention as illustrated in FIG. 1 includes elongated, rigid members 3 and 4. The elongated rigid member 3 as shown has a curved cradle or anvil 7 adjacent one end and a handle portion 9 adjacent the other end. The rigid member 3 further has a knife blade member 11 (see also FIG. 2) mounted thereto adjacent the anvil end 7 for pivotal movement about the axis 13. The knife blade member 11 as seen in FIG. 2 has a cutting edge 15 extending along a first peripheral section and a plurality of ratchet teeth 17, 17', and 17" extending along a second peripheral section 19. In the open position of FIG. 2, the cutting edge 15 is spaced from the curved anvil 7 to receive the pipe P to be cut therebetween.

The second, elongated rigid member 4 as also shown in FIGS. 1 and 2 has a handle portion 8 and is mounted to the other rigid member 3 for pivotal movement about the axis 21. The rigid member 4 in turn has a drive pawl 10 (see FIG. 2) mounted thereto for pivotal movement about the axis 12. The axis 12 in this regard is substantially parallel to the axis 13 of the knife blade member 11 and the axis 21 of the handle portions 8 and 9. The drive pawl 10 is biased by the spring arrangement 14 (FIG. 2) to pivot about the axis 12 in a first rotational direction (e.g., clockwise in FIG. 2) to engage the peripheral section 19 of the knife blade member 11 and the plurality of ratchet teeth extending along the section 19.

The ratcheting arrangement of the cutting tool 1 to progressively move the cutting edge 15 of the knife blade member 11 in a step-by-step manner toward the anvil 7 is illustrated in FIGS. 2-10. The ratcheting arrangement includes the plurality of ratchet teeth 17, 17', and 17" (FIG. 2) extending along the peripheral section 19, the drive pawl 10, and the catch pawl 25. The drive pawl 10 as indicated above is mounted to the rigid member 4 (FIG. 2) for pivotal movement about the axis 12. The drive pawl 25 like the catch pawl 10 is also biased by a spring arrangement 29 in a first rotational direction (e.g., counterclockwise in FIG. 2) to engage the peripheral section 19 and the plurality of ratchet teeth extending therealong.

Figure 3:
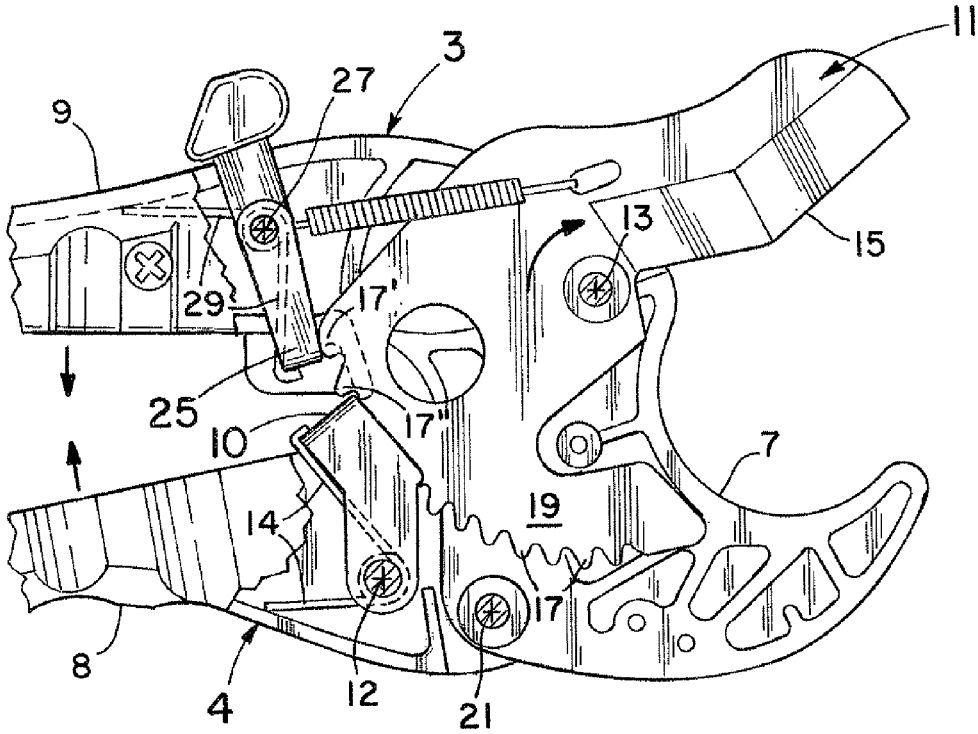
FIGS. 3-11 in conjunction with FIG. 2 sequentially show how the ratcheting arrangement can be operated in a step-by-step manner to progressively move the cutting edge of the knife blade member toward the anvil to cut a plastic pipe positioned therebetween.
Figure 4:
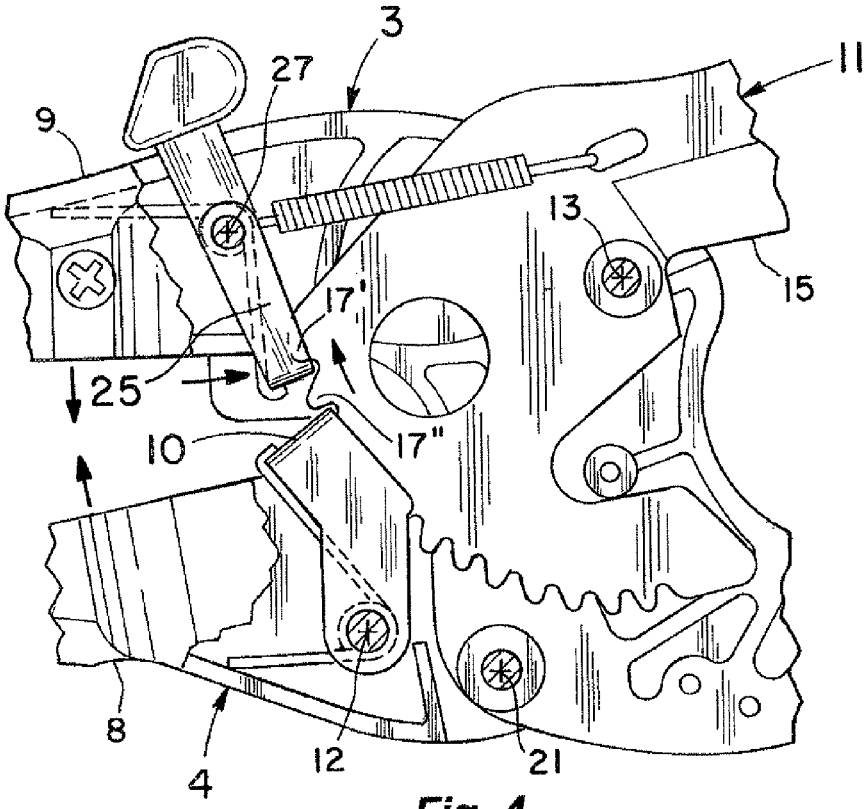
Figure 5:
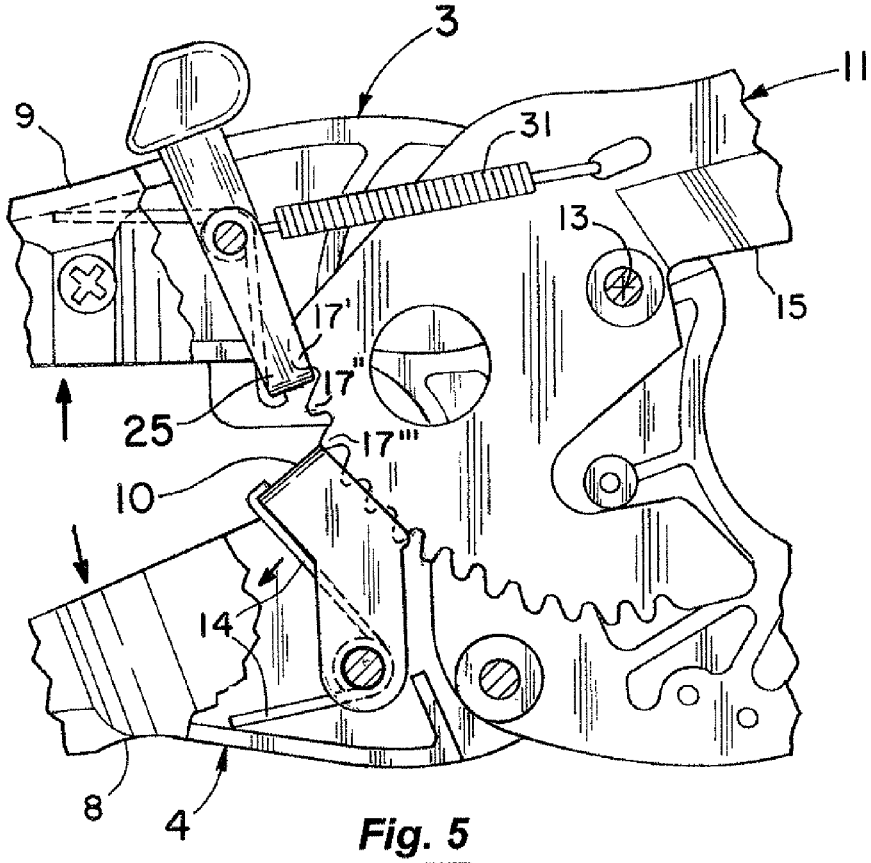
Figure 6:
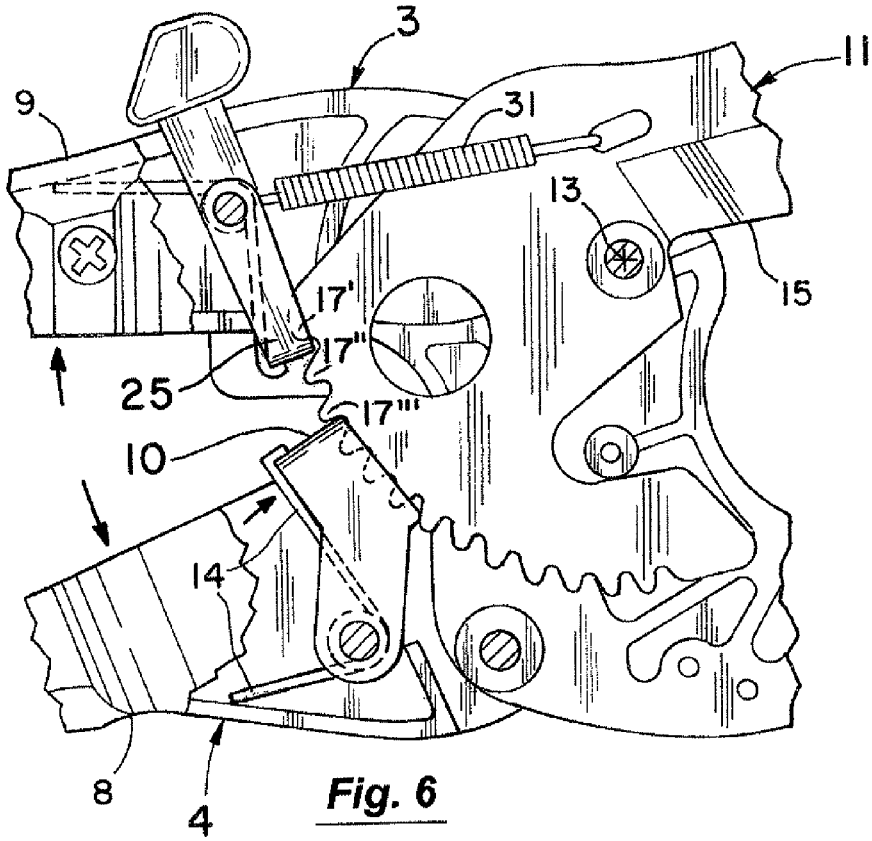
Figure 7:
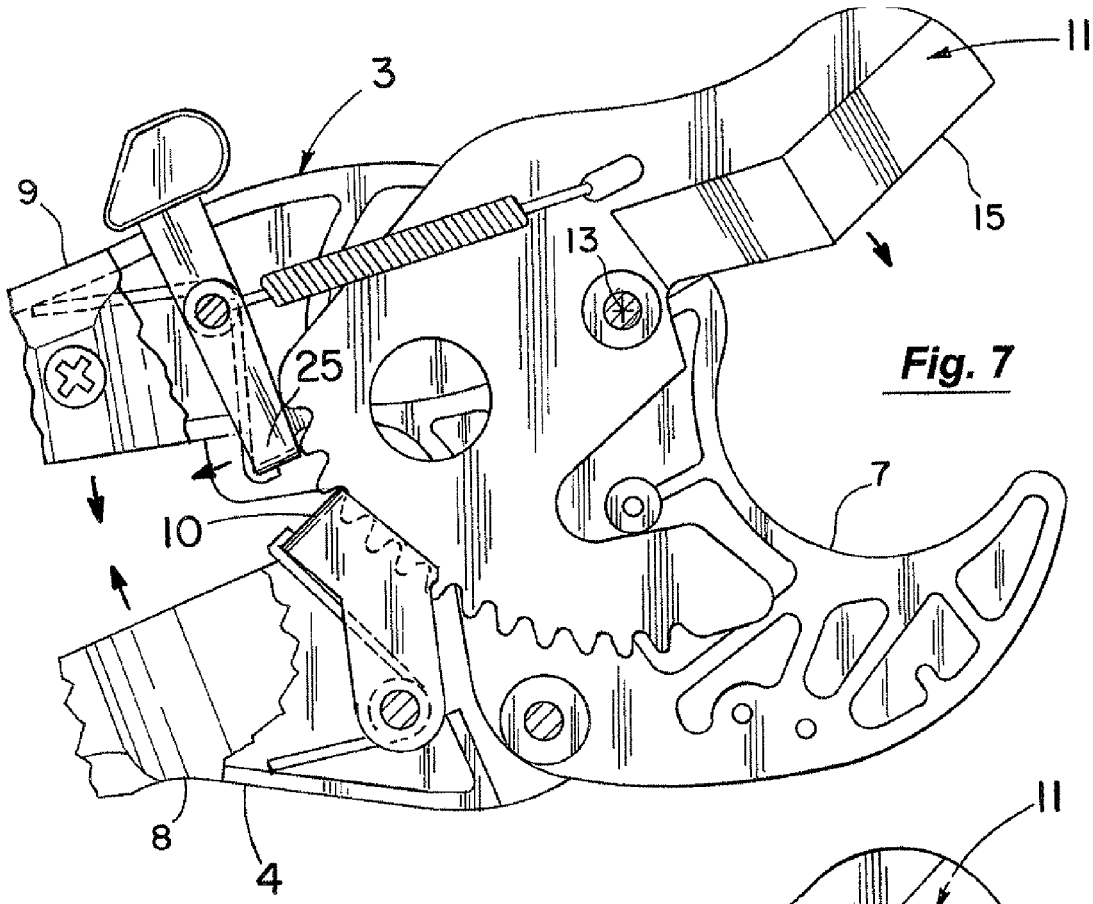
Figure 8:
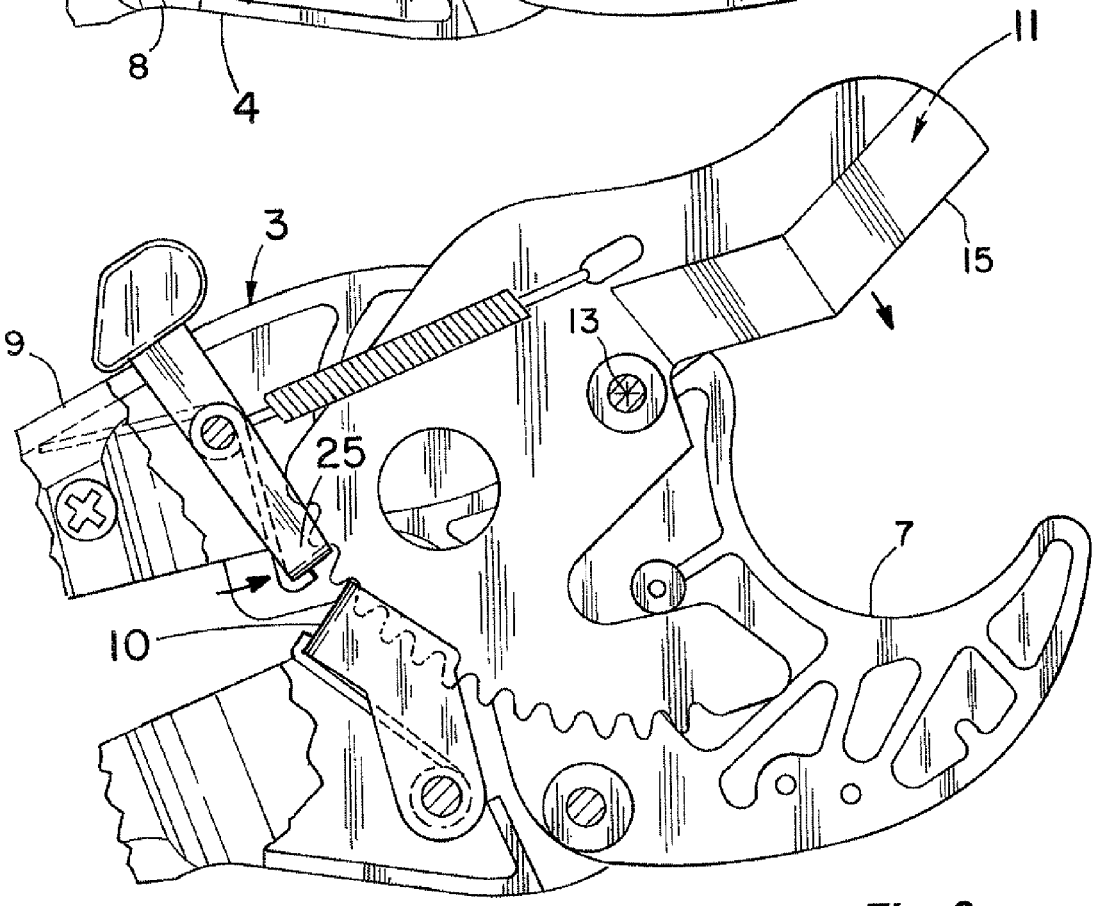
Figure 9:
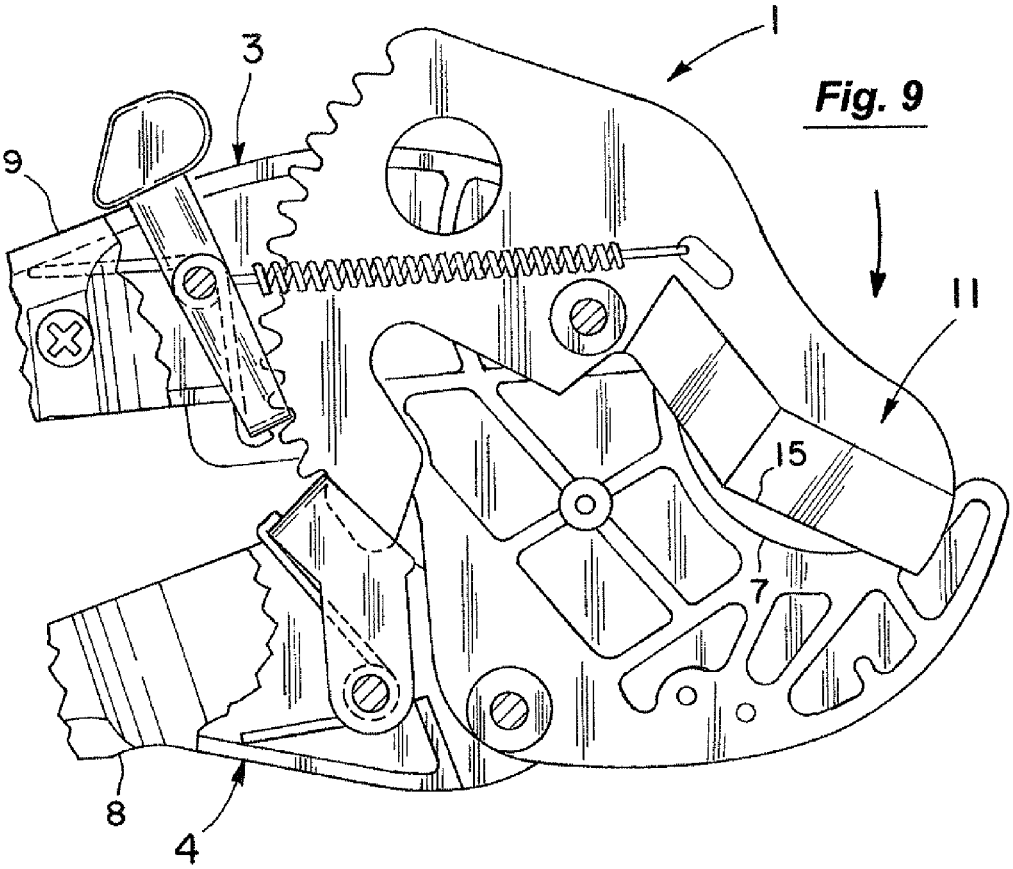
Figure 10:
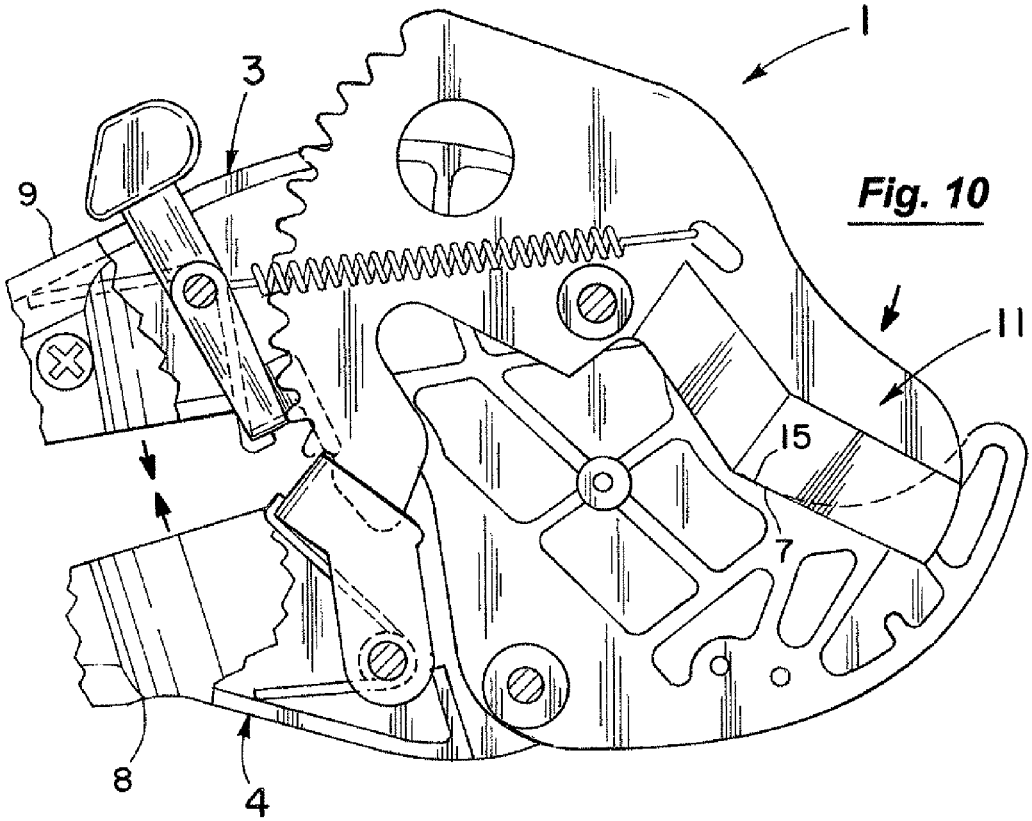

In operation, the handle portions 8 and 9 of FIGS. 1 and 2 are first squeezed toward each other about the handle axis 21 from the position of FIG. 2 to that of FIG. 3 and on to the position of FIG. 4. In doing so with the catch pawl 25 biased against the tooth 17' as in FIG. 2, the movement of the drive pawl 10 of FIG. 2 that is engaged with the ratchet tooth 17" will drive the knife blade member 11 and its cutting edge 15 in a clockwise direction (FIG. 3) about the axis 13. During this motion, the catch pawl 25 rides up (FIG. 3) and over (FIG. 4) the ratchet tooth 17' to the engaging position of FIG. 4. The handle portions 8 and 9 are then separated (FIG. 5) wherein is the drive pawl 10 rides up (FIG. 5) and over (FIG. 6) the adjacent tooth 17''' with the spring arrangement 14 in FIG. 6 biasing the drive pawl 10 into engagement with the tooth 17'''. During this action of the drive pawl 10 in FIGS. 5-6, the catch pawl 25 continues to engage the tooth 17' and in cooperation with the tensioned spring 31 prevents any rotational movement of the knife blade member 11 about the axis 13. The process can then be repeated (FIGS. 7-8) until the cutting edge 15 of the knife blade member 11 is moved nearer to the anvil 7 (FIG. 9) and eventually to a position partially overlapping (FIG. 10) or completely overlapping (FIG. 11) the anvil 7 to cut through any pipe therebetween.

Figure 11:
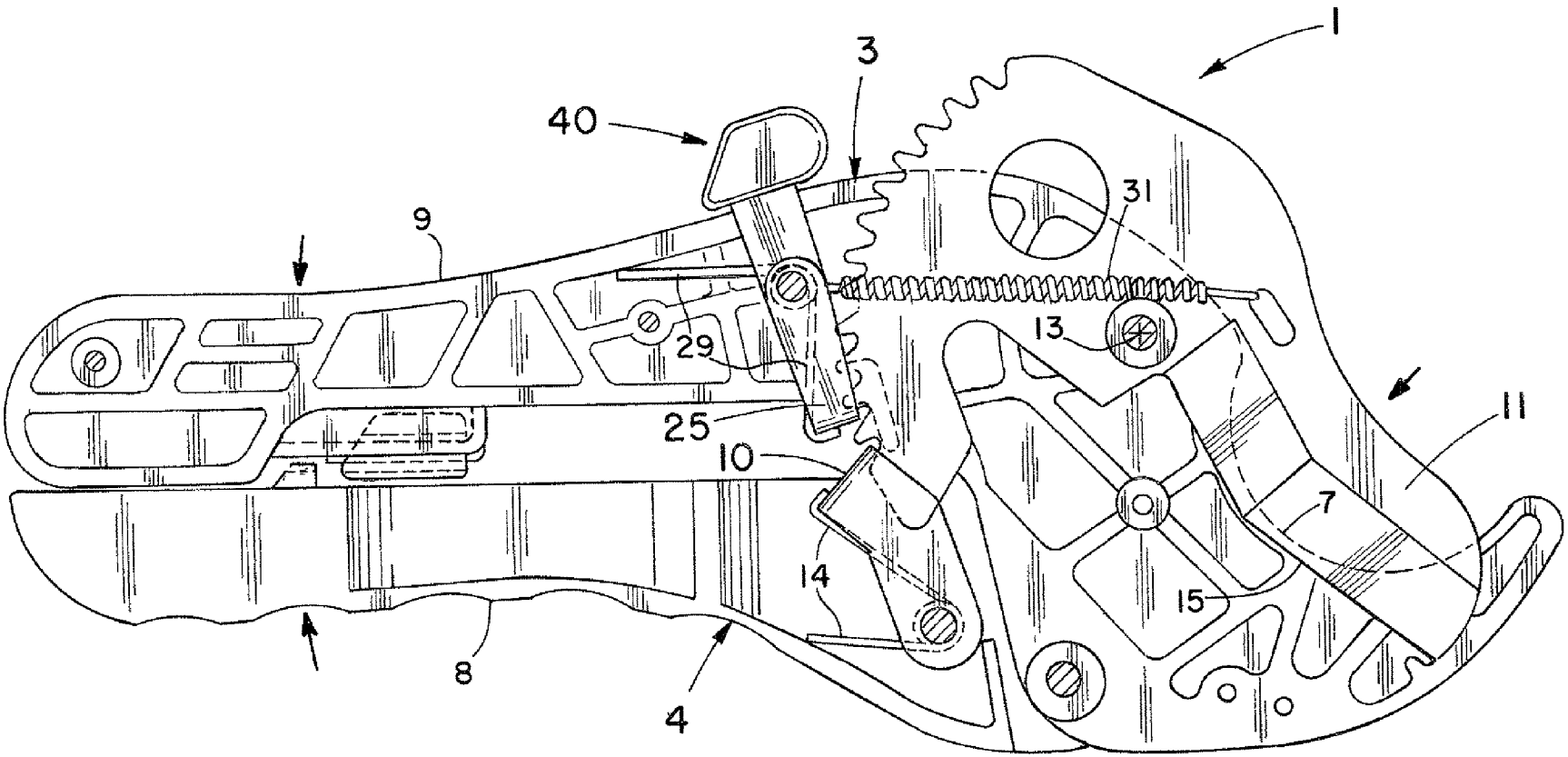
Figure 12:
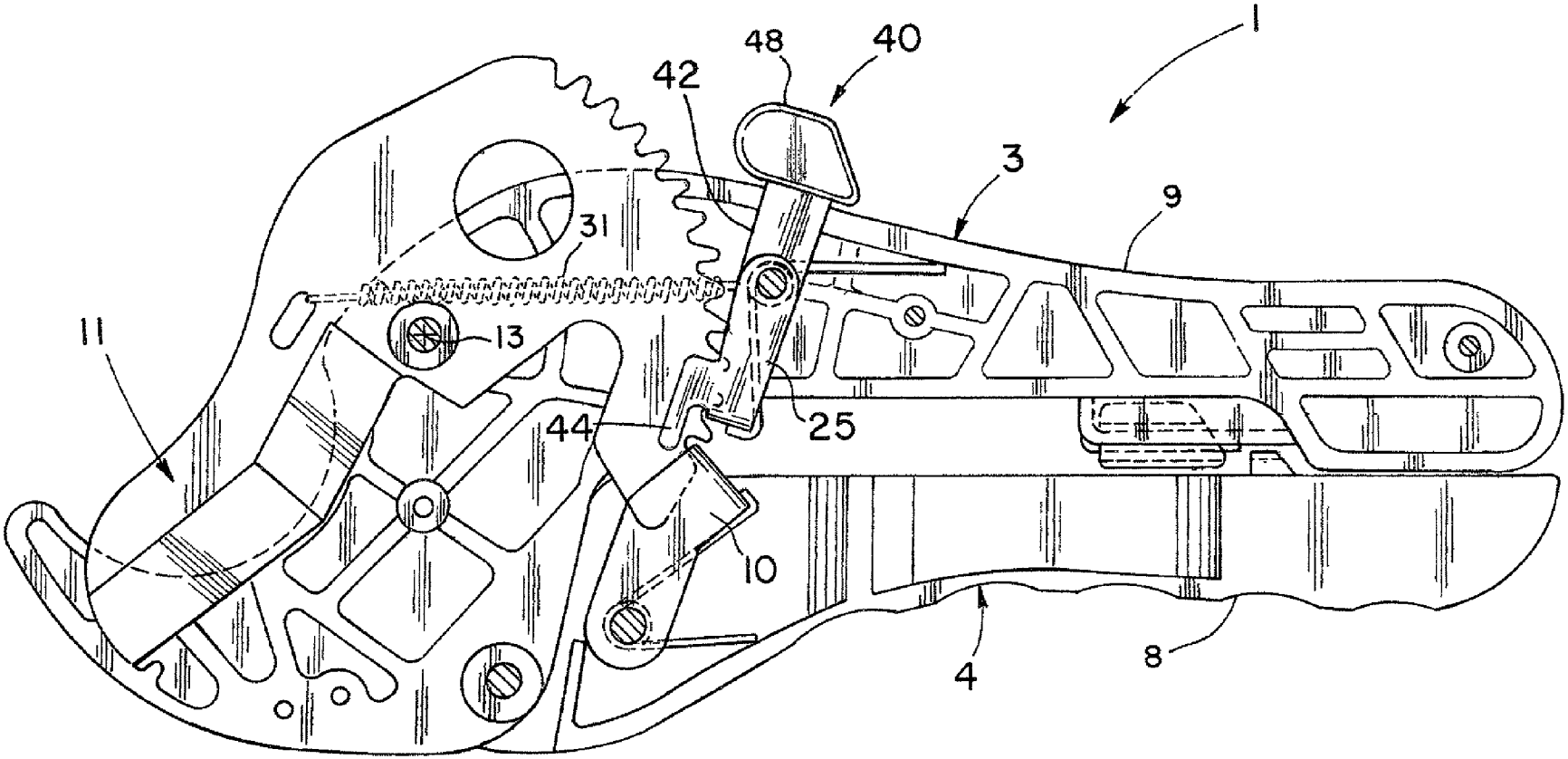
FIG. 12 is a rear view of FIG. 11 illustrating the structure of the release mechanism.

To release the drive pawl 10 and catch pawl 25 from their respective biased engagement with the ratchet teeth 17 in FIG. 11, the cutting tool 1 is provided with a manual release mechanism 40. In operation, the release mechanism 40 will move both the drive pawl 10 and catch pawl 25 against the forces of their respective spring arrangements 14 and 29 to respective release positions. More specifically, the release mechanism 40 (see FIG. 12 which is a rear view of FIG. 11) includes first 42 and second 44 extension pieces rigidly mounted to the catch pawl 25. As explained in more detail below, the parts 42, 44, and 25 form a rigid, one-piece lever member. In operation, the outwardly exposed activator at end 48 of the lever member can be manually pushed forward in FIG. 13 (e.g., by the users thumb) and rotated as in FIG. 13 about the axis 27. In doing so, the catch pawl 25 is also rotated about the axis 27 away from engagement with the plurality of ratchet teeth 17 extending along the peripheral section 19. Additionally, the elongated extension piece or finger 44 in FIGS. 13 and 14 will then contact the base 10' of the U-shaped drive pawl 10 and move the drive pawl 10 away from engagement with the plurality of ratchet teeth 17. This contacting of the second extension piece or finger 44 with the drive pawl 10 is perhaps been seen in FIG. 14*a* (which is a view taken along line 14*a*-14*a* of FIG. 14).

Figure 14A:
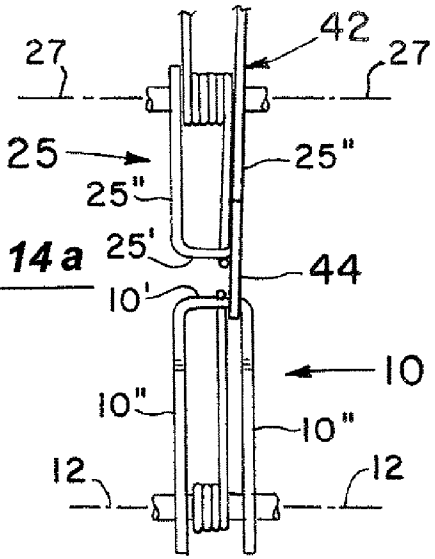
Figure 14:
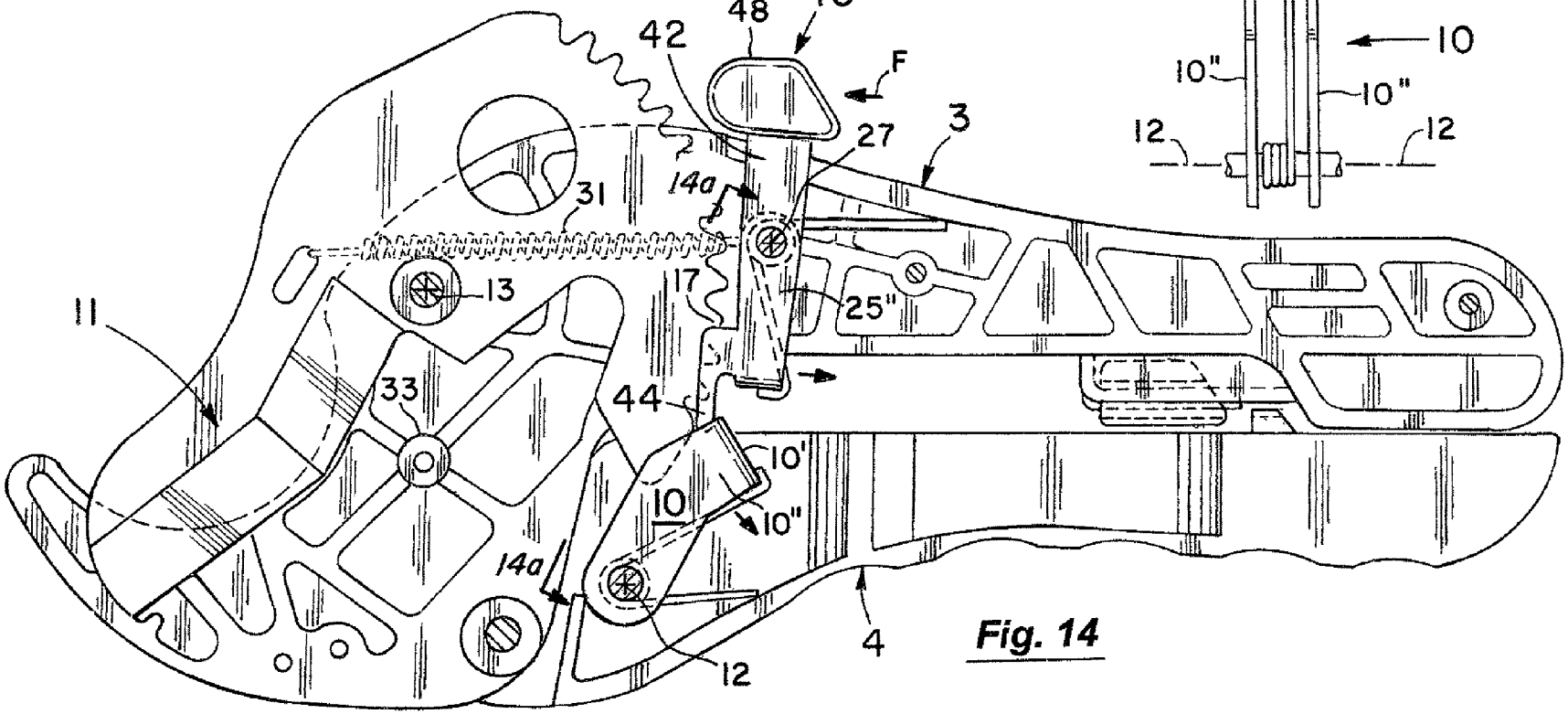

Both the drive and catch pawls 10,25 in this regard are preferably U-shaped (see again FIG. 14*a*) with the respective base members 10',25' of the U-shapes extending between the respective two legs 10",25". It is noted that the extension pieces 42,44 as illustrated in FIG. 14 extend outwardly of the axis 27 and the catch pawl 25 preferably in substantially opposite directions. Additionally, the elongated finger 44 as shown in FIG. 14*a* preferably extends outwardly from one of the legs 25" of the U-shaped catch pawl 25.

Figure 15:
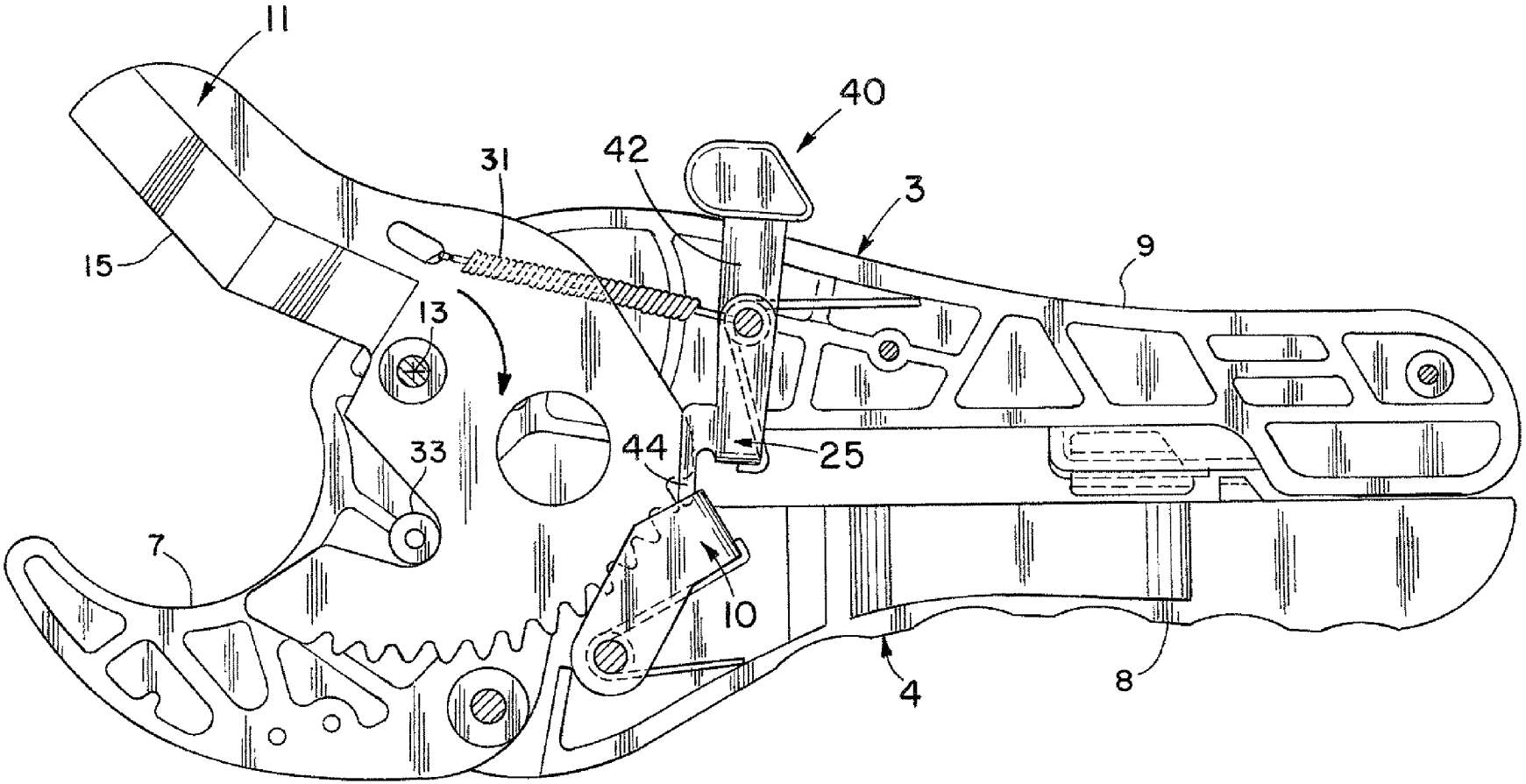

At the point of FIG. 14 with both the drive pawl 10 and catch pawl 25 in their respective release positions, the spring 31 for the knife blade member 11 can rotate the knife blade member 11 clockwise in FIG. 15 about the axis 13. This will then move the cutting edge 15 of the knife blade member 11 away from the anvil 7 as in FIG. 15 to its original open position to receive another pipe to be cut as in FIG. 2. The spring 31 of FIG. 15 in this regard rotates the knife blade member 11 clockwise until it abuts the stop member 33 affixed to the underlying rigid member 3.

Figures 13, 13A:
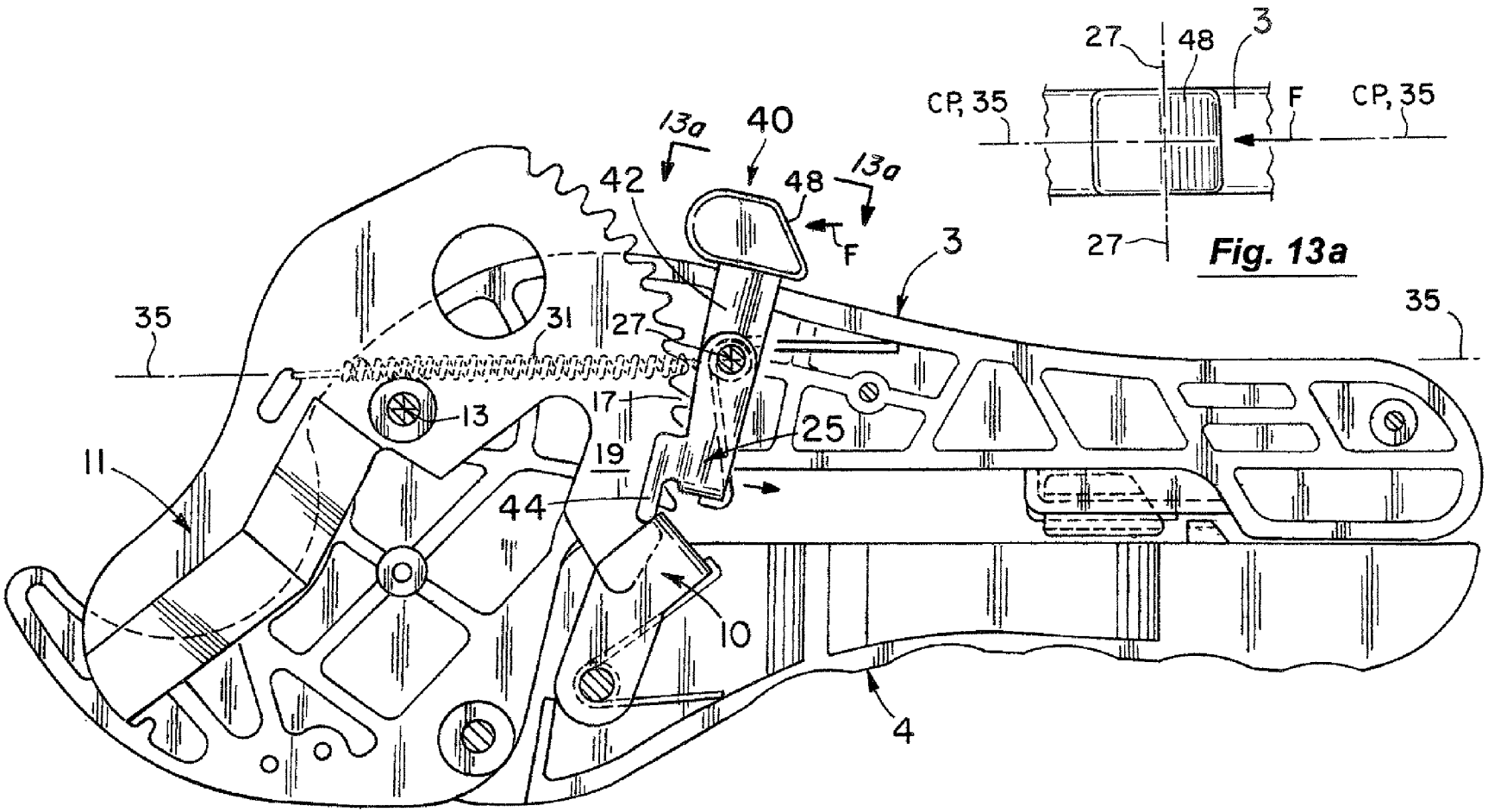
FIGS. 13-15 in conjunction with FIG. 12 sequentially show how the release mechanism can be manipulated to move the drive and catch pawls to their release positions spaced from the ratchet teeth to permit the spring-biased blade to be automatically returned to its open position after each cut.

In this manner, the manual manipulation of a single, one-piece lever member of 42, 44, and 25 about the central axis 27 will release both the drive pawl 10 and the catch pawl 25 in one motion. Further, the force F to activate the release in FIGS. 13, 13*a*, and 14 is applied to the exposed end 48 of the lever member (see FIG. 13*a*) in a direction substantially perpendicular to the axis 27. The applied force F is also essentially in or immediately adjacent the central place CP of the rigid members 3 and 4. The applied force F of FIGS. 13 and 13*a* and the movement of the lever member 42, 44, and 25 of the release mechanism 40 are then effectively in or along the central plane CP (FIG. 13*a*). Consequently, there is little or no torque or twisting force on the cutting tool 1 in the user's hand about a longitudinal axis such as 35 in FIGS. 13 and 13*a*.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. In a ratcheting cutting tool for cutting plastic pipe, said cutting tool having first and second, elongated rigid members (3,4) with respective handle portions and mounted to each other for pivotal movement about a handle axis (21), said cutting tool further having a knife blade member (11) mounted to the first rigid member (3) for pivotal movement about a first axis (13) substantially parallel to said handle axis (21), said first rigid member (3) having an anvil (7) and said knife blade member having a cutting edge (15) extending along a first peripheral section thereof, said cutting edge being spaced in a first position from said anvil to receive the pipe therebetween with the cutting edge thereafter progressively moved about said first axis (13) toward the anvil in a step-by-step manner to a second position to cut through the pipe by repeatedly squeezing the handle portions (8,9) together about said handle axis (21), the knife blade member having a plurality of ratchet teeth extending along a second peripheral section (19) thereof and being selectively engaged by a drive pawl (10) mounted to the second rigid member (4) for pivotal movement about a second axis (12) substantially parallel to said handle axis (21) and said first axis (13) and biased by a first spring arrangement (14) in a first rotational direction about the second axis (12) toward engagement with the ratchet teeth, the cutting tool further having a catch pawl (25) mounted to the first rigid member (3) for pivotal movement about a third axis (27) substantially parallel to the handle, first, and second axes in a first rotation direction about the third axis (27) toward engagement with the ratchet teeth, the improvement including:

a manually operated release mechanism (40) to move both the drive pawl (10) and catch pawl (25) away from the respective biased engagements with the ratchet teeth, said release mechanism including first (42) and second (44) extension pieces, said first (42) and second (44) extension pieces being rigidly mounted to said catch pawl (25) in respective fixed positions relative to the catch pawl (25) and to each other wherein manual movement of the first extension piece (42) in a rotational direction about said third axis (27) opposite to said first rotation direction of said catch pawl (25) moves the catch pawl (25) in said opposite rotational direction about the third axis (27) to a release position away from engagement with said ratchet teeth and wherein said manual movement of said first extension piece (42) in said rotational direction about said third axis (27) opposite to the first rotational direction of said catch pawl further moves the second extension piece (44) to contact and rotate said drive pawl (10) in a rotational direction about the second axis (12) opposite to the first rotational direction of the drive pawl (10) to a release position away from engagement with said ratchet teeth.

2. The improvement of claim 1 wherein said knife blade member (11) is biased by a second spring arrangement (31) toward said first position with the cutting edge (15) thereof spaced from said anvil (7) and is moved by said second spring arrangement (31) to said first position with the drive pawl (10) and catch pawl (25) in said respective release positions.

3. The improvement of claim 2 further including a stop member (33) affixed to said first rigid member (3) and contacting said knife blade member with said cutting edge thereof in said first position spaced from the anvil.

4. The improvement of claim 1 wherein said first and second extension pieces (42,44) of said release mechanism (40) extend outwardly in substantially opposite directions from the third axis (27) of the catch pawl (25).

5. The improvement of claim 1 wherein said anvil is curved to receive a portion of the pipe therein.

6. The improvement of claim 1 wherein said drive pawl and catch pawl are substantially U-shaped with two legs and a base member extending therebetween with the respective base members (10',25') of the drive and catch pawls biased by the respective spring arrangements (14,29) to engage said ratchet teeth.

7. The improvement of claim 1 wherein the respective spring arrangements (14,29) of said drive and catch pawls (10,25) bias the drive and catch pawls toward opposite rotational directions about the respective second (12) and third (27) axes.

8. In a ratcheting cutting tool for cutting plastic pipe, said cutting tool having first and second, elongated rigid members (3,4) with respective handle portions and mounted to each other for pivotal movement about a handle axis (21), said cutting tool further having a knife blade member (11) mounted to the first rigid member (3) for pivotal movement about a first axis (13) substantially parallel to said handle axis (21), said first rigid member (3) having an anvil (7) and said knife blade member having a cutting edge (15) extending along a first peripheral section thereof, said cutting edge being spaced in a first position from said anvil to receive the pipe therebetween with the cutting edge thereafter progressively moved about said first axis (13) toward the anvil in a step-by-step manner to a second position to cut through the pipe by repeatedly squeezing the handle portions (8,9) together about said handle axis (21), the knife blade member having a plurality of ratchet teeth extending along a second peripheral section (19) thereof and being selectively engaged by a drive pawl (10) mounted to the second rigid member (4) for pivotal movement about a second axis (12) substantially parallel to said handle axis (21) and said first axis (13) and biased by a spring arrangement (14) in a first rotational direction about the second axis (12) toward engagement with the ratchet teeth, the cutting tool further having a catch pawl (25) mounted to the first rigid member (3) for pivotal movement about a third axis (27) substantially parallel to the handle, first, and second axes in a first rotation direction about the third axis (27) toward engagement with the ratchet teeth, the improvement including:

a manually operated release mechanism (40) to move both the drive pawl (10) and catch pawl (25) away from the respective biased engagements with the ratchet teeth, said release mechanism including first (42) and second (44) extension pieces rigidly mounted to said catch pawl (25) wherein manual movement of the first extension piece (42) in a rotational direction about said third axis (27) opposite to said first rotation direction of said catch pawl (25) moves the catch pawl (25) in said opposite rotational direction about the third axis (27) to a release position away from engagement with said ratchet teeth and wherein said manual movement of said first extension piece (42) in said rotational direction about said third axis (27) opposite to the first rotational direction of said catch pawl further moves the second extension piece (44) to contact and rotate said drive pawl (10) in a rotational direction about the second axis (12) opposite to the first rotational direction of the drive pawl (10) to a release position away from engagement with said ratchet teeth wherein said first and second extension pieces extend outwardly of the catch pawl (25) in substantially opposite directions.

9. In a ratcheting cutting tool for cutting plastic pipe, said cutting tool having first and second, elongated rigid members (3,4) with respective handle portions and mounted to each other for pivotal movement about a handle axis (21), said cutting tool further having a knife blade member (11) mounted to the first rigid member (3) for pivotal movement about a first axis (13) substantially parallel to said handle axis (21), said first rigid member (3) having an anvil (7) and said knife blade member having a cutting edge (15) extending along a first peripheral section thereof, said cutting edge being spaced in a first position from said anvil to receive the pipe therebetween with the cutting edge thereafter progressively moved about said first axis (13) toward the anvil in a step-by-step manner to a second position to cut through the pipe by repeatedly squeezing the handle portions (8,9) together about said handle axis (21), the knife blade member having a plurality of ratchet teeth extending along a second peripheral section (19) thereof and being selectively engaged by a drive pawl (10) mounted to the second rigid member (4) for pivotal movement about a second axis (12) substantially parallel to said handle axis (21) and said first axis (13) and biased by a spring arrangement (14) in a first rotational direction about the second axis (12) toward engagement with the ratchet teeth, the cutting tool further having a catch pawl (25) mounted to the first rigid member (3) for pivotal movement about a third axis (27) substantially parallel to the handle, first, and second axes in a first rotation direction about the third axis (12) toward engagement with the ratchet teeth, the improvement including:

a manually operated release mechanism (40) to move both the drive pawl (10) and catch pawl (25) away from the respective biased engagements with the ratchet teeth, said release mechanism including first (42) and second (44) extension pieces rigidly mounted to said catch pawl (25) wherein manual movement of the first extension piece (42) in a rotational direction about said third axis (27) opposite to said first rotation direction of said catch pawl (25) moves the catch pawl (25) in said opposite rotational direction about the third axis (27) to a release position away from engagement with said ratchet teeth and wherein said manual movement of said first extension piece (42) in said rotational direction about said third axis (27) opposite to the first rotational direction of said catch pawl further moves the second extension piece (44) to contact and rotate said drive pawl (10) in a rotational direction about the second axis (12) opposite to the first rotational direction of the drive pawl (10) to a release position away from engagement with said ratchet teeth wherein said catch pawl (25) and said first and second extension pieces (42,44) are part of a single, one-piece lever member substantially centrally mounted to said first rigid member (3) at said third axis (27).

10. The improvement of claim 9 wherein said second extension piece (44) extends outwardly of the third axis (27) farther than said catch pawl (25).

11. The improvement of claim 9 wherein said second extension piece (44) extends outwardly of the third axis (27) from the catch pawl (25).

12. The improvement of claim 9 wherein said second extension piece (44) is an elongated finger member.

13. The improvement of claim 12 wherein said drive pawl (10) is a substantially U-shaped member with two legs and a base member (10') extending therebetween and said elongated finger member (44) contacts the base (10') of the drive pawl to move the drive pawl to the release position thereof.

14. The improvement of claim 13 wherein said catch pawl (25) is a substantially U-shaped member with a base member (25') extending between two legs (25") and said elongated finger member (44) is an extension of one of said legs.

15. The improvement of claim 9 wherein said first extension piece (42) extends outwardly of the third axis (27) and rigid member (3) to expose an end thereof for manual manipulation to move said lever member about said third axis (27).

16. The improvement of claim 15 wherein said lever member is moved about said third axis (27) substantially along a plane (CP) substantially perpendicular to the third axis (27).

17. The improvement of claim 16 wherein said plane (CP) extends substantially centrally of said first and second, elongated rigid members (3,4).

* * * * *